US006122864A

United States Patent [19]

Martin

[11] Patent Number: 6,122,864

[45] Date of Patent: Sep. 26, 2000

[54] FLOATING WEATHER-STRIP FOR USE WITH A FIXED JAMBLINER

[75] Inventor: Jeffrey S. Martin, Cottage Grove, Minn.

[73] Assignee: Amesbury Group, Inc., Manchester-by-the-Sea, Mass.

[21] Appl. No.: 09/228,376

[22] Filed: Jan. 12, 1999

Related U.S. Application Data

[60] Provisional application No. 60/071,011, Jan. 13, 1998.

[51] Int. Cl.[7] ..... E05D 15/16; E06B 7/16

[52] U.S. Cl. ..... 49/428; 49/475.1

[58] Field of Search ..... 49/428, 414, 475.1, 49/451, 456, 457, 434, 176, 181; 52/204.5

[56] References Cited

U.S. PATENT DOCUMENTS

| | | | |
|---|---|---|---|
| 722,305 | 3/1903 | Hultmark . | |
| 818,703 | 4/1906 | McGinnis . | |
| 971,261 | 9/1910 | Frisbee . | |
| 1,113,157 | 10/1914 | Forsyth . | |
| 1,559,502 | 10/1925 | Campbell . | |
| 1,632,789 | 6/1927 | Domscheit . | |
| 1,728,344 | 9/1929 | Hellstrand . | |
| 1,953,743 | 4/1934 | Burrell | 20/49 |
| 2,187,459 | 1/1940 | Lorenz | 20/68 |
| 2,719,342 | 10/1955 | Hunt | 20/66 |
| 2,766,860 | 10/1956 | Travis | 189/70 |
| 2,876,506 | 3/1959 | Knebel | 20/53 |
| 3,114,179 | 12/1963 | Briggs | 20/56.5 |
| 3,145,433 | 8/1964 | Jones | 49/414 |
| 3,203,053 | 8/1965 | Lane et al. | 20/56.5 |
| 3,269,062 | 8/1966 | Mears, Jr. | 49/505 |
| 3,374,821 | 3/1968 | White | 160/40 |
| 3,461,608 | 8/1969 | Johnson | 49/414 |
| 3,562,954 | 2/1971 | Duguay | 49/318 |
| 3,842,564 | 10/1974 | Brown | 52/716 |
| 3,940,898 | 3/1976 | Kaufman | 52/400 |
| 4,004,389 | 1/1977 | DiFazio | 52/398 |
| 4,012,878 | 3/1977 | Ellingson | 52/288 |
| 4,034,510 | 7/1977 | Huelsekopf | 49/419 |
| 4,034,514 | 7/1977 | Cecil | 49/504 |
| 4,128,967 | 12/1978 | Kirsch | 49/318 |
| 4,266,387 | 5/1981 | Karlsson | 52/731 |
| 4,299,060 | 11/1981 | Tippmann | 49/501 |
| 4,307,542 | 12/1981 | Lense | 49/318 |
| 4,454,687 | 6/1984 | Baker | 49/419 |
| 4,470,222 | 9/1984 | Killingsworth | 49/419 |
| 4,538,380 | 9/1985 | Colliander | 49/475 |
| 4,563,381 | 1/1986 | Woodland | 428/156 |
| 4,712,330 | 12/1987 | Beirnes | 49/484 |
| 4,720,936 | 1/1988 | Ellingson | 49/480 |
| 4,726,148 | 2/1988 | Tix | 49/453 |
| 5,199,219 | 4/1993 | Martini et al. | 49/414 |
| 5,245,788 | 9/1993 | Riegelman | 49/465 |
| 5,265,308 | 11/1993 | May et al. | 16/197 |
| 5,375,376 | 12/1994 | Scott | 49/480.1 |
| 5,414,962 | 5/1995 | Forbis et al. | 49/454 |
| 5,526,608 | 6/1996 | Stark | 49/419 |
| 5,575,116 | 11/1996 | Carlson et al. | 49/449 |
| 5,581,951 | 12/1996 | Ryan et al. | 49/498.1 |
| 5,671,566 | 9/1997 | Tix et al. | 49/419 |
| 5,675,937 | 10/1997 | Stebel | 49/453 |
| 5,699,636 | 12/1997 | Stark | 49/419 |

OTHER PUBLICATIONS

Astro Plastics Catalog Sheet, 1992 (Month Not Available).

*Primary Examiner*—Daniel P. Stodola
*Assistant Examiner*—Hugh B. Thompson
*Attorney, Agent, or Firm*—Testa, Hurwitz & Thibeault LLP

[57] ABSTRACT

The floating weather-strip includes a sealing member and a support member having a spline for interfitting attachment to a jambliner to prevent the infiltration of air or water in the check-rail area between window sashes in a window assembly during sliding or tilting. The sealing member can include a foam material, and can be disposed on an upper and a lower surface of the support member. The removable attachment of the weather-strip to the jambliner facilitates replacement after installation, as well as customization of the compression characteristics to achieve specific biasing and sealing needs.

10 Claims, 5 Drawing Sheets

FLOATING WEATHER-STRIP FOR USE WITH A FIXED JAMBLINER

This application claims the benefit of U.S. Provisional Application Ser. No. 60/071,011, filed Jan. 13, 1998.

FIELD OF THE INVENTION

This invention relates to a weather-strip for use a window assembly, more particularly to a floating weather-strip for use with a fixed window jamb or jambliner for enhanced sealing.

BACKGROUND OF THE INVENTION

Double hung window assemblies generally include a frame, an upper window sash, a lower window sash, a pair of balances, and a pair of jambliners. The jambliners are each attached to a window jamb to guide the movement of the window sashes. Due to the tendency of air, water and other particulate matter to infiltrate the space between the sashes, jambliners have been fabricated to include integral sealing members. One such jambliner is disclosed in U.S. Pat. No. 5,2365,308, in which a carpet-like sealing material is integrally formed on the web portion of the jambliner that interconnects the guideways that receive the sashes. Such a seal can often fail in alleviating the infiltration of air and water.

SUMMARY OF THE INVENTION

The present invention relates to a floating weather-strip for use with a fixed jamb or jambliner that affords increased resistance to air and water infiltration in the area between the window sashes.

In one embodiment, the weather-strip comprises a support member having an upper foam member for sealing against the edges of a pair of window sashes, an a lower foam member disposed against the mullion of a jambliner. In still another embodiment, the support member comprises a pair of splines forming an interfitting connection with a pair of retaining arms in the jambliner.

In another embodiment, the weather-strip comprises a support member comprising a thermoplastic shell having a pair of splines forming an interfitting connection with a pair of sockets formed in a jambliner. In another embodiment, the thermoplastic shell surrounds a foam core.

In still another embodiment, the weather-strip forms an interfitting connection with the jambliner in the check-rail area, such that the weather-strip is compressed against the window sash during movement or tilting thereof.

These and other features of the invention will be made apparent from the description below and the claims.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION OF THE INVENTION

Figure 1:
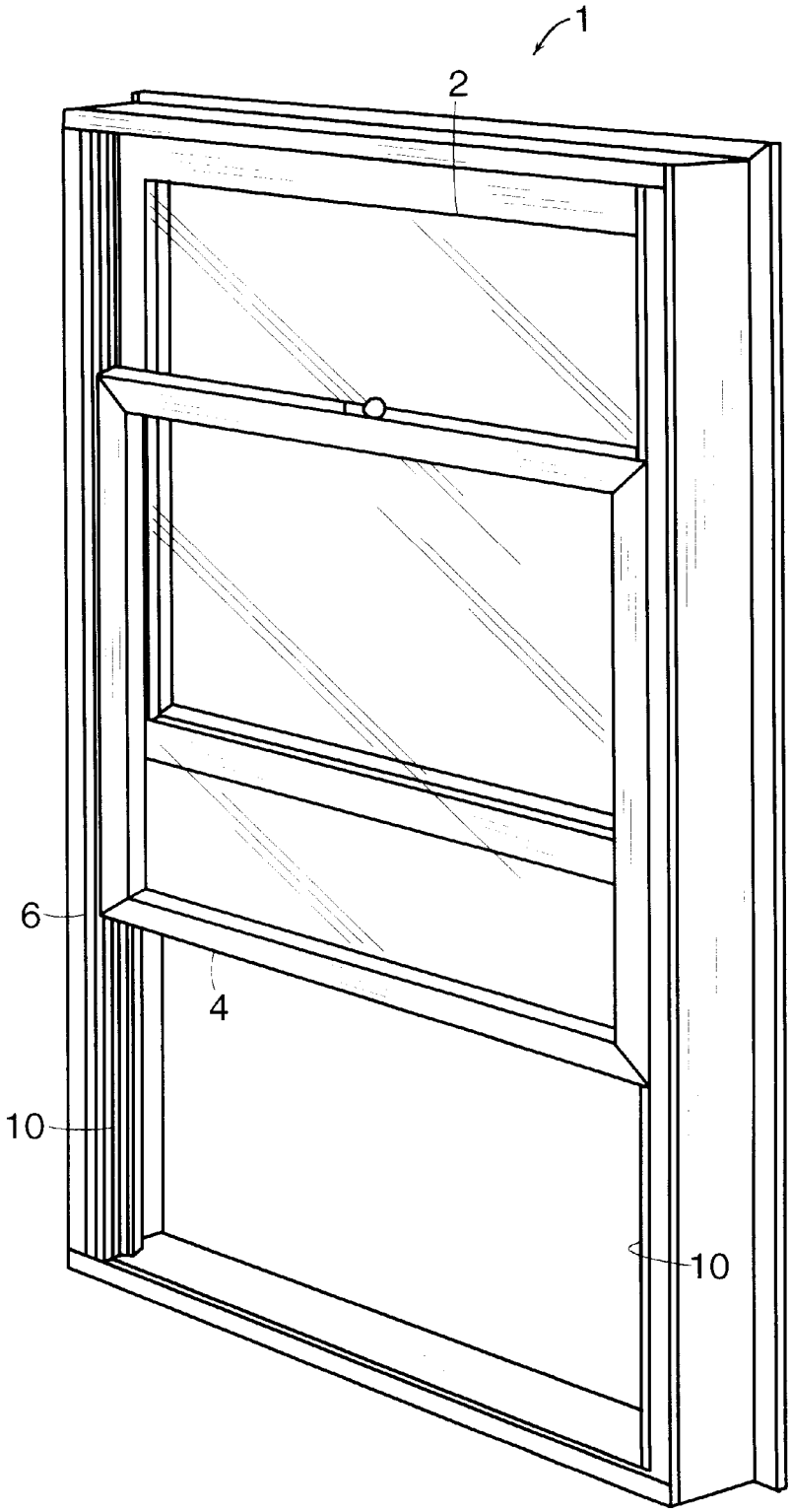
FIG. 1 is a perspective view of a double hung window assembly in which the floating weather-strip of the present invention can be used.

Referring to FIG. 1, shown is a double-hung window assembly 1 in which a floating weather-strip constructed in accordance with the teachings of the present invention, can be used for sealing the area between the upper window sash 2 and the lower window sash 4. The upper and lower sashes 2, 4 are supported by a pair of jambliners 10, one on each side of the window jamb 6, within which is supported the weather-strip (not shown) of the present invention.

Figure 2:
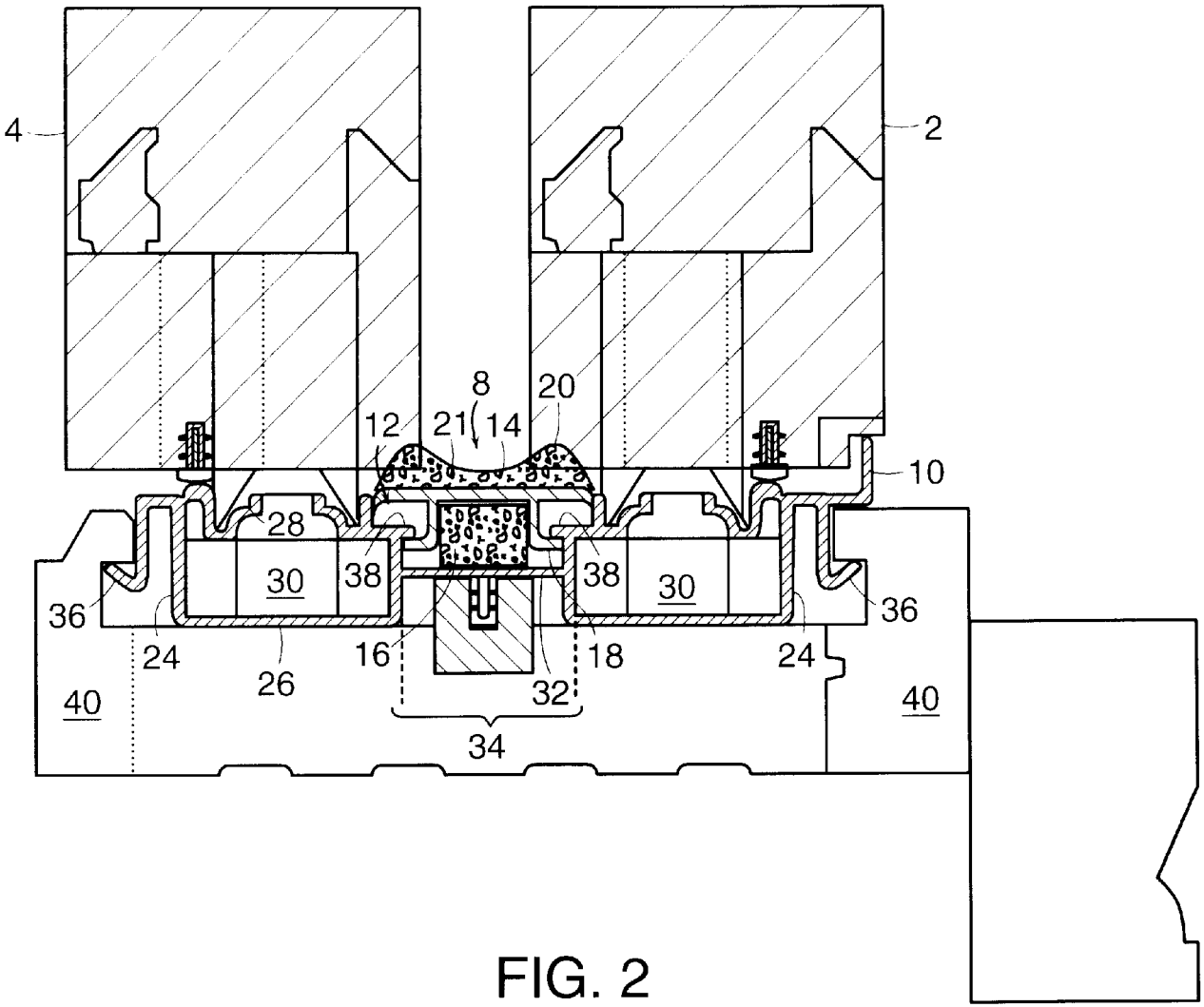
FIG. 2 is a cross-sectional view of a floating weather-strip for use with a jambliner according to one embodiment of the invention.

Referring to FIG. 2, shown is one embodiment of the weather-strip 8 of the present invention. As shown, the weather-strip 8 comprises a T-shaped support member 12, preferably formed of polyvinylchloride (PVC) or thermoplastic elastomer (TPE). The support member 12 can include an upper foam member 14 disposed on the top side of the support member 12 and a lower foam member 16 disposed on the bottom side of the support member 12 between a pair of splines 18. The upper foam member 14 can be concave in shape, with end portions 20, each having a the greater thickness than the thickness of the center of the foam member 14. The concave end portions 20 preferably reside underneath the inner edge of each window sash 2, 4, as will be further described. The lower foam member 16 is preferably a block-like member sized to reside between the splines 18 for disposition against the jambliner 10. It is to be appreciated that the present invention is not to be limited to the user of PVC, TPE or foam, and that other sealing members can be used. In another embodiment, the upper foam member 14 can be filled in with a polypropylene material such that the foam member 14 forms a block-shaped member.

As shown, the jambliner 10 with which the weather-strip 8 forms an interfitting connection, defines a pair of tracks, each for guiding a sash 2, 4. The jambliner 10 is preferably formed of PVC, having varying degrees of hardness, and includes a pair of sash-engaging members each comprising a pair of side walls 24, a bottom wall 26, and a pair of shortened walls 28, all of which cooperate to form a pair of elongated tracks 30. The tracks 30 are substantially identical, one configured to guide a lower sash (not shown), and the other configured to guide an upper sash (not shown). The tracks 30 further permit each sash 2, 4 to slide vertically and tilt from the window frame, in response to forces exerted thereon.

As shown, the tracks 30 are connected by a mullion 32, which defines the check-rail portion 34 that exists between the sashes 2, 4. The mullion 32 includes a pair of retaining arms 38 which retain the splines 18 of the weather-strip 8. In this manner, the weather-strip 8 is floating, in that it is not permanently affixed to the jambliner 10. In another embodiment, the splines 18 of the floating weather-strip 8 can have slightly curved ends to further retain the weather-strip 8 against the retaining arms 38 in the check-rail area 34. Disposed on either side of the tracks 30 is an edge member 36 that can be used to mount the jambliner 10 to the window jamb 40. Projecting from the bottom wall 26 can be a sealing and attaching member (not shown) for sealing and attaching the jambliner within the window jamb.

Figure 3:
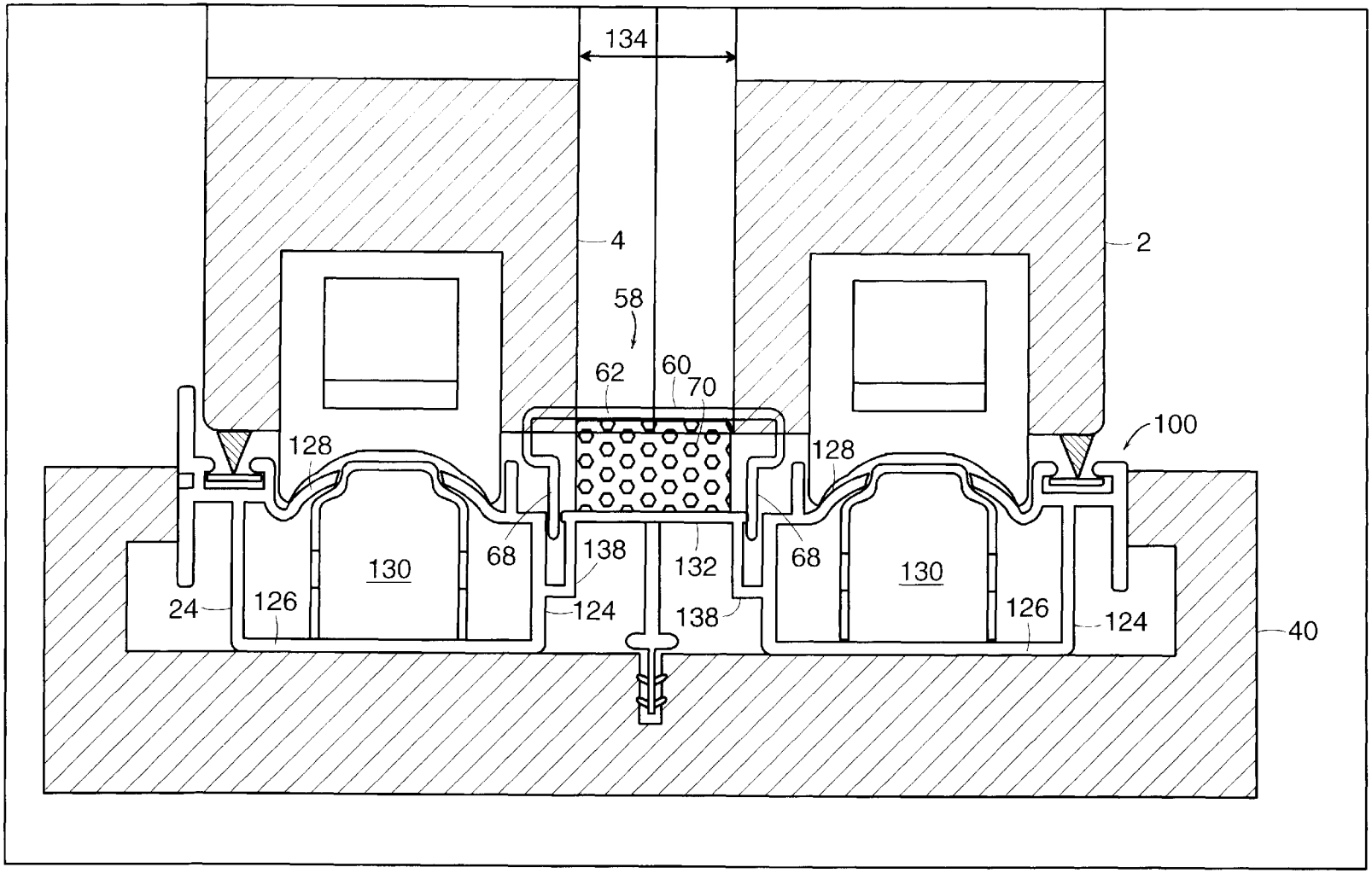
FIG. 3 is a cross-sectional view of a floating weather-strip for use with a jambliner according to another embodiment of the present invention.

Referring to FIG. 3, shown is a weather-strip 58 for use with a fixed jambliner 100 according to another embodiment of the invention. In an effort to eliminate redundancy, like elements shown and described above, are not further described herein. As shown, the weather-strip 58 according to the present embodiment, is disposed in the checkrail portion 134 between the window sashes 2, 4. In the present embodiment, the weather-strip comprises an outer sealing portion 60, which can comprise PVC or TPE. The outer sealing portion preferably forms a U-shaped member having a support portion 62 having a pair of splines 68 extending perpendicularly therefrom. Disposed within the area defined by the pair of splines 68 is a foam member 70. It is to be appreciated that the present invention is not to be limited to the user of PVC, TPE or foam, and that other sealing members can be used.

As shown, the weather-strip 58 forms an interfitting connection with the jambliner 100. The jambliner 100 of the present embodiment is similar in configuration to the jambliner 10 described above in FIG. 2, and includes a plurality of walls 124, 126, 128 forming a pair of tracks 130. The mullion 132 disposed between the tracks 130 further includes a pair of receiving sockets 138, each of which are sized to receive one of the splines 68. In this manner, the splines 68 secure the weather-strip 58 in place against the jambliner 100.

Figure 4:
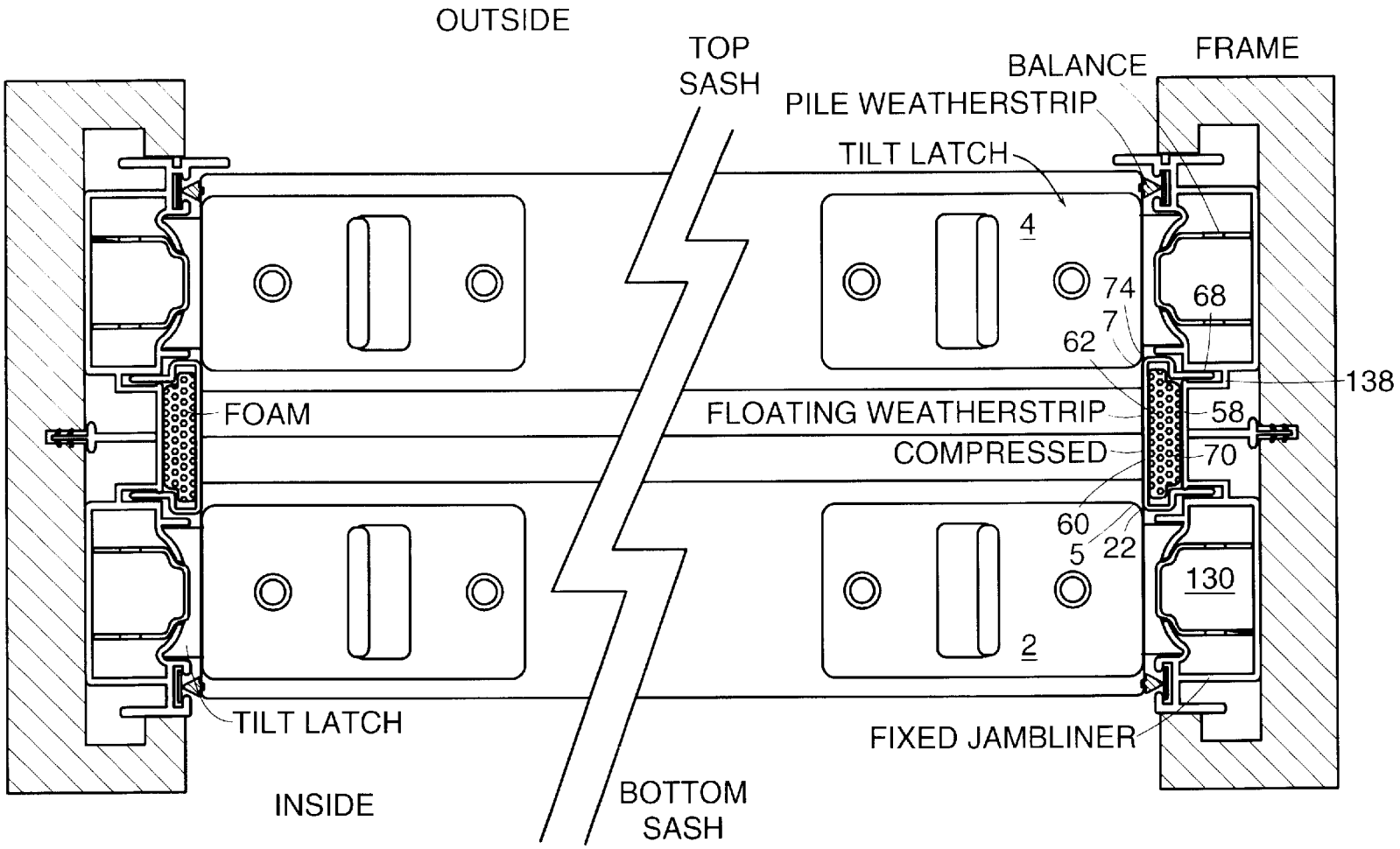
FIG. 4 is a cross-sectional view of a window frame assembly accommodating a pair of floating weather-strips to seal the area between the window sashes during movement or tilting thereof.

Referring to FIG. 4, for purposes of illustration, the operation of the weather-strip 58 of FIG. 3 is described. As shown, the outer edges 72, 74 of the weather-strip 58 are disposed under an inner edge 5, 7 of each sash 2, 4 in a compressed state. As each sash 2, 4 is moved vertically within the track 130 or tilted at an angle away from the vertical axis of the track 130, the weather strip 58 remains compressed and fills the space in the check rail portion 134. As a result, the infiltration of air or water in between the sashes 2, 4, is prevented.

Referring again to FIG. 2, the operation of the weather-strip 8 is carried out in a similar manner as described in FIG. 4. The support member 12 resides within the check rail 34 portion of the jambliner 10, and the concave portions 20 of the upper foam member 14 are each disposed under an inner edge 5, 7 of the window sash 2, 4. The center portion 21 of the upper foam member 14 and the lower foam member 16, is disposed between the sashes 2,4. The upper foam member 14 remains compressed while the sashes 2,4 undergo both vertical sliding movement and tilting movement. As the upper foam member 14 is compressed, the lower foam member 16 is compressed against the mullion 32 of the jambliner 10.

Figure 5:
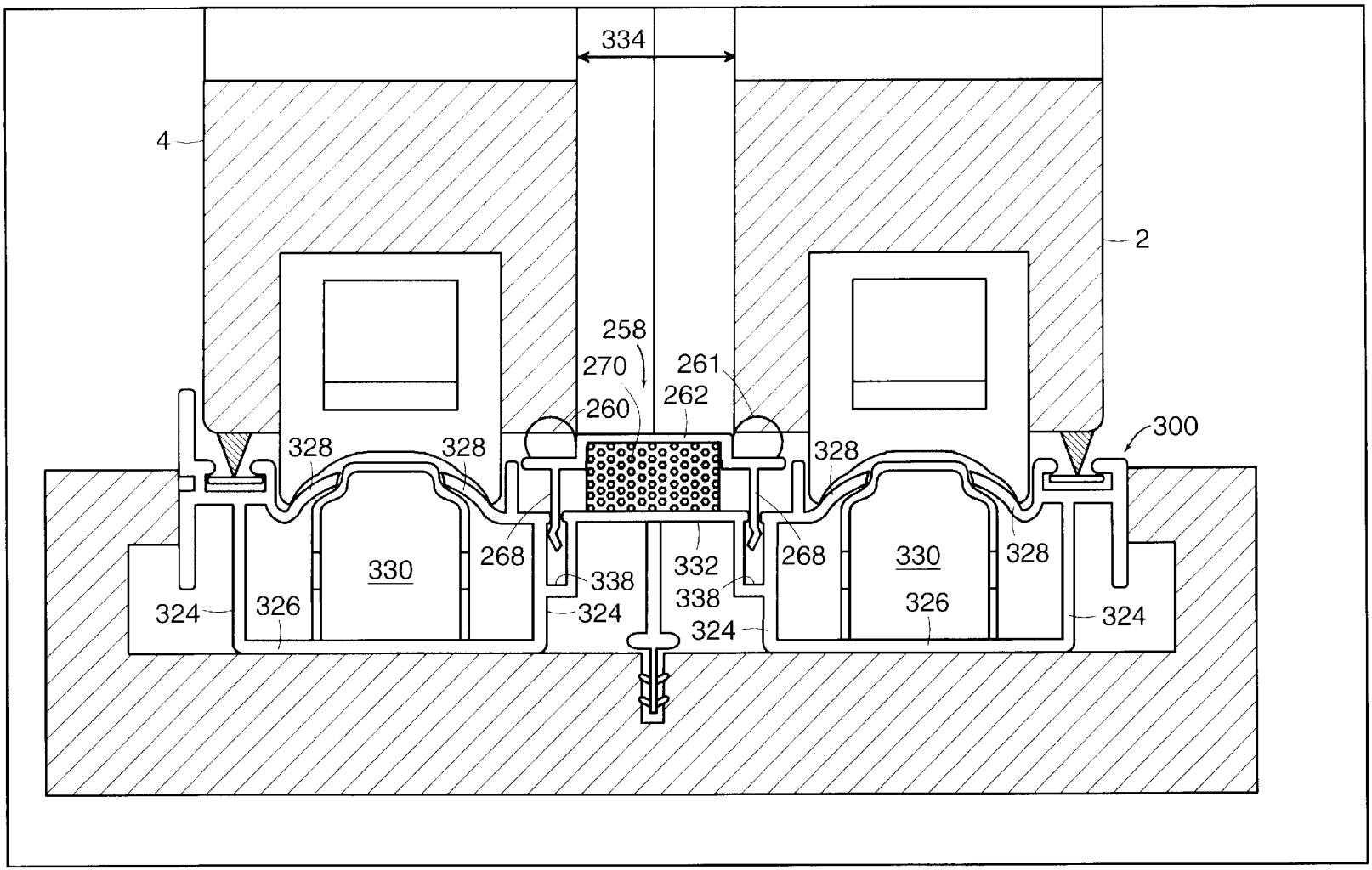
FIG. 5 is a cross-sectional view of a floating weather-strip for use with a jambliner according to yet another embodiment of the present invention

Referring to FIG. 5, shown is a weather-strip 258 for use with a fixed jambliner 300 according to another embodiment of the invention. In an effort to eliminate redundancy, like elements shown and described above, are not further described herein. As shown, the weather-strip 258 according to the present embodiment, is disposed in the checkrail portion 334 between the window sashes 2, 4. In the present embodiment, the weather-strip comprises a pair of outer sealing portions 260, 261, which can comprise PVC, TPE, or other sealing materials. The outer sealing portions 260, 261 are preferably bulb-shaped seal members on a top surface of the support portion 262 having a pair of splines 268 extending generally perpendicularly therefrom. Disposed within the area defined by the pair of splines 268 is a foam member 270. It is to be appreciated that the present invention is not to be limited to the user of PVC, TPE or foam, and that other sealing members can be used.

As shown, the weather-strip 258 forms an interfitting connection with the jambliner 300. The jambliner 300 of the present embodiment is similar in configuration to the jambliner 10 described above in FIG. 2, and includes a plurality of walls 324, 326, 328 forming a pair of tracks 330. The mullion 332 disposed between the tracks 330 further includes a pair of receiving sockets 338, each of which are sized to receive slidably one of the splines 268. In this manner, the splines 268 secure the weather-strip 258 in place against the jambliner 300.

The floating weather-strip construction of the present invention increases the flexibility that the user has in repairing the weather-strip, as well as in customizing a weather-strip to meet desired biasing and sealing needs. In the above embodiments, the weather-strip can have a compression rating within the range of 0.25 lb/inch to 1.5 lb/inch. It is to be appreciated, however, that the material comprising the weather-strip can take the form of a variety of shapes and sizes, and that other compressing ratings are within the scope of the invention. Moreover, the weather-strip can have other means for removable attachment to the jambliner, while preventing the infiltration of air and water in the check-rail area between the window sashes during the sliding or tilting thereof.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

What is claimed is:

1. A weather-strip for use in a checkrail area between a pair of window sashes, comprising:

a support member having a top surface extending at least partially beyond respective side edges of both window sashes upon installation in the checkrail area between the pair of window sashes, said support member defining an interior space;

a first sealing member disposed within said interior space;

a second sealing member disposed on and in contact with said top surface of said support member across substantially an entire width of said top surface and extending at least partially beyond the respective side edges of both window sashes upon installation; and a connecting member disposed from said support member, and surrounding said first sealing member.

2. The weather-strip according to claim 1, wherein at least one of said first and second sealing members comprise foam.

3. The weather-strip according to claim 1, wherein said support member comprises polyvinylchloride or thermoplastic elastomer.

4. A window assembly including a sealing system and a pair of double-hung, full-tilt window sashes, the window assembly comprising:

a weather-strip comprising:

a support member having a top surface extending at least partially beyond respective side edges of both window sashes upon installation in a checkrail area between the pair of window sashes said support member defining an interior space, said support member including a spline;

a first seal disposed within said interior space; and a second seal disposed on and in contact with said top surface of said support member across substantially an entire width of said top surface and extending at least partially beyond the respective side edges of both window sashes upon installation;

a jambliner having a pair of sash-engaging members, each sash-engaging member comprising opposed wall sections and a bottom wall and spaced from the other sash-engaging member by a mullion, said mullion comprising a retaining member; and wherein said retaining member receives said spline such that said weather-strip is removably attached to said jambliner.

5. The sealing system according to claim 4, said support member further comprising a pair of splines, and said mullion further comprising a pair of retaining members.

6. The sealing system according to claim 4, wherein said weather-strip resides within a check-rail portion between the pair of window sashes.

7. The sealing system according to claim 4, wherein said weather-strip has a compression rating within the range of 0.25 lb/inch to 1.5 lb/inch.

8. The sealing system according to claim 4, wherein said retaining member comprises a projection emanating from said mullion to hook around said spline.

9. The sealing system according to claim 4, wherein said retaining member comprises a socket formed within said mullion.

10. The sealing system according to claim 4, said weather-strip further comprising a pair of outer sealing portions disposed on a top surface of said support member, each of which seals against a respective one of the pair of window sashes.

* * * * *